US010629076B2

(12) United States Patent
Mayer

(10) Patent No.: US 10,629,076 B2
(45) Date of Patent: Apr. 21, 2020

(54) DETERMINATION OF LATERALLY REMOTE PARKING SPACES

(71) Applicant: Robert Bosch GmbH, Stuttgart (DE)

(72) Inventor: Philipp Mayer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/099,231

(22) PCT Filed: May 10, 2017

(86) PCT No.: PCT/EP2017/061207
§ 371 (c)(1),
(2) Date: Nov. 6, 2018

(87) PCT Pub. No.: WO2018/007054
PCT Pub. Date: Jan. 11, 2018

(65) Prior Publication Data

US 2019/0156674 A1 May 23, 2019

(30) Foreign Application Priority Data

Jul. 8, 2016 (DE) ..... 10 2016 212 505

(51) Int. Cl.
*G08G 1/14* (2006.01)
*G08G 1/01* (2006.01)
*G08G 1/056* (2006.01)

(52) U.S. Cl.
CPC ..... *G08G 1/143* (2013.01); *G08G 1/0112* (2013.01); *G08G 1/0129* (2013.01); *G08G 1/0141* (2013.01); *G08G 1/056* (2013.01)

(58) Field of Classification Search
CPC .... G08G 1/143; G08G 1/0112; G08G 1/0129; G08G 1/0141; G08G 1/056
See application file for complete search history.

(56) References Cited

U.S. PATENT DOCUMENTS 10,043,388 B1 * 8/2018 Kahn ..... G08G 1/146
2008/0048885 A1 * 2/2008 Quinn ..... G08G 1/143 340/932.2

(Continued)

FOREIGN PATENT DOCUMENTS

DE 102004062021 A1 7/2006
DE 102006036423 A1 2/2008

(Continued)

OTHER PUBLICATIONS

International Search Report dated Aug. 24, 2017 of the corresponding International Application PCT/EP2017/061207 filed May 10, 2017.

*Primary Examiner* — Joseph H Feild
*Assistant Examiner* — Rufus C Point
(74) *Attorney, Agent, or Firm* — Norton Rose Fulbright US LLP; Gerard Messina

(57) ABSTRACT

A method includes a plurality of first motor vehicles traveling along a section of a street in the same direction of travel; scanning of a right side of the street by a first sensor directed laterally to the right, and a left side of the street by a second sensor directed laterally to the left on each first motor vehicle; determining right parking spaces on the right side of the street based on data from the first sensor and left parking spaces on the left side of the street based on data from the second sensor; ascertaining a confidence value based on a first accumulation with which right parking spaces were determined in the section, and based on a second accumulation with which left parking spaces were determined in the section; and assigning the confidence value to the section and to the direction of travel.

7 Claims, 5 Drawing Sheets

(56) References Cited

U.S. PATENT DOCUMENTS

| | | | | |
|---|---|---|---|---|
| 2009/0171567 | A1* | 7/2009 | Morimoto | G01C 21/3605 701/465 |
| 2013/0085636 | A1* | 4/2013 | You | B60W 30/06 701/25 |
| 2014/0058711 | A1* | 2/2014 | Scofield | G06Q 10/04 703/6 |
| 2014/0085112 | A1* | 3/2014 | Gruteser | B60Q 9/004 340/932.2 |
| 2015/0379873 | A1* | 12/2015 | Tippelhofer | G08G 1/143 340/932.2 |
| 2016/0140845 | A1* | 5/2016 | Agrawal | G08G 1/144 340/932.2 |
| 2016/0196747 | A1* | 7/2016 | Tsyrklevich | G08G 1/143 701/532 |
| 2017/0016738 | A1* | 1/2017 | Sakuma | G01C 21/3415 |
| 2017/0025008 | A1* | 1/2017 | Gignac | G08G 1/143 |
| 2017/0248955 | A1* | 8/2017 | Banvait | G05D 1/0255 |
| 2017/0355307 | A1* | 12/2017 | Ha | G08G 1/143 |
| 2017/0364776 | A1* | 12/2017 | Micks | G05D 1/0088 |
| 2018/0308359 | A1* | 10/2018 | Hayakawa | B60W 30/06 |

FOREIGN PATENT DOCUMENTS

| | | | |
|---|---|---|---|
| DE | 102008028550 | A1 | 12/2009 |
| DE | 102009028024 | A1 | 2/2011 |
| DE | 102011003881 | A1 | 8/2012 |
| DE | 102012201472 | A1 | 8/2013 |
| DE | 102012222810 | A1 | 6/2014 |
| DE | 102013211632 | A1 | 12/2014 |
| DE | 102015211514 | A1 | 12/2016 |

* cited by examiner

DETERMINATION OF LATERALLY REMOTE PARKING SPACES

CROSS-REFERENCE TO RELATED APPLICATIONS

The present application is the national stage of International Pat. App. No. PCT/EP2017/061207 filed on Oct. 5, 2017, and claims priority under 35 U.S.C. § 119 to DE 10 2016 212 505.2, filed in the Federal Republic of Germany on Jul. 8, 2016, the content of each of which are incorporated herein by reference in their entireties.

FIELD OF THE INVENTION

The present invention relates to the scanning of a parking space from a motor vehicle. In particular, the invention relates to the scanning of a parking space on the left side of the vehicle in the case of right-hand traffic or on the right side of the vehicle in the case of left-hand traffic.

BACKGROUND

A motor vehicle is able to be parked in a parking space which is located at the edge of a street between other parked vehicles. The use of the parking space can be free of charge or subject to charge. Various approaches are known for finding, managing, and seeking such parking spaces.

DE 10 2004 062 021 A1 relates to the centralized collecting of information about parking spaces.

DE 10 2008 028 550 A1 proposes the sensing of parking spaces from traveling motor vehicles.

DE 10 2009 028 024 A1 describes how a motor vehicle can be guided to a free parking space.

A motor vehicle includes laterally directed sensors to detect a parking space. If a parking space is determined, the vehicle can then use it, or transmit information about the parking space to a management system. If the vehicle is on a street network with right-hand traffic, thus, it is usually traveling on the right side of the street, then the scanning of a parking space situated on the right side of the motor vehicle is substantially easier and more reliable than the scanning of a parking space situated on the left side of the vehicle, which is further away from the vehicle, and in the meantime, can be obscured by passing or oncoming motor vehicles.

SUMMARY

An object of the present invention is to provide an improved determination of a parking space.

According to an example embodiment of the present invention, a method includes a plurality of first motor vehicles traveling along a section of a street in the same direction of travel; scanning a right side of the street by a first sensor directed laterally to the right, and a left side of the street by a second sensor directed laterally to the left on each first motor vehicle; determining right parking spaces on the right side of the street based on data from the first sensor and left parking spaces on the left side of the street based on data from the second sensor; ascertaining a confidence value based on a first accumulation with which right parking spaces were determined in the section, and on based on a second accumulation with which left parking spaces were determined in the section; and assigning the confidence value to the section and its direction of travel.

In general, the following explanations are based on the assumption that right-hand traffic prevails, thus, a motor vehicle on a street is usually using the right lane. However, the invention is usable in corresponding application for streets with left-hand traffic, as well.

The invention is based on the recognition that on certain streets, especially on narrow streets or one-way streets, parking spaces determined on the left side of the street are more marked, that is, are more in line with parking spaces determined on the right side. The scanning of parking spaces by a plurality of first motor vehicles makes it possible to assess whether such a correlation exists on a street or a section, and whether scanning on the left side is presumably realistic, or whether it cannot be assumed that a parking space determined on the left side of the motor vehicle is also actually available. The higher the confidence value, the greater the trust the determination of a parking space on the left side is usable. In particular, the method can be used to create a data collection which in each case assigns a confidence value to different sections of a street network. In so doing, the confidence value is linked to the direction of travel, so that the first motor vehicles and a second motor vehicle looking for a parking space must be traveling in the same direction.

In an example embodiment, the confidence value is determined in such a way that the better the first and second accumulations along the street correspond to each other, the higher the confidence value. In this case, the street is probably relatively narrow or only traveled in one direction, and the scannings on the left side are subject to only small sources of error.

In a further example embodiment, the confidence value is determined in such a way that the more the second accumulation is made up of measurement noise, the lower the confidence value. If parking spaces determined on the left side differ only a little from the measurement noise, the confidence value is thus low. In this manner, a signal-to-noise ratio can be taken into account. In an example embodiment, parking spaces determined on the left side can be discarded completely if the second accumulation lies below a predetermined threshold value with respect to the measurement noise.

In another example embodiment, the first motor vehicles can drive along the street many times in a predetermined direction and determine parking spaces on the right side. Third motor vehicles can drive along the street—before, during, or afterward—in the opposite direction, in the course of which parking spaces are determined on the left side. The confidence value can be ascertained in such a way that the better the accumulations of parking spaces determined by the first motor vehicles correspond to or correlate with accumulations of parking spaces determined by the third vehicles, the higher the confidence value.

Preferably, the measurement noise is determined as uniformly distributed second accumulations along the street. These accumulations usually have a relatively low level.

In an example, the greater the number of scannings by first motor vehicles, the less the measurement noise. Measurement noise is able to be reduced by increasing a number of measuring operations that are as independent of each other as possible. Therefore, the determination of the measurement noise can be a function of the number of scannings by first motor vehicles. In practice, it has turned out that a good differentiation between significant second cumulations and measurement noise is usually possible after scanning by approximately 500 first motor vehicles. In other embodiments, good distinguishability was also attained in the case of approximately 300 or even approximately 200 first motor vehicles.

In addition, it is preferred that the confidence value is determined in such a way that the more marked the second cumulation along the street, the higher the confidence value.

A further method includes a second motor vehicle traveling along a section of a street in one direction of travel; scanning of a usually remote side of the street by a laterally directed sensor; determining a parking space based on the scanning; determining a confidence value with respect to the section and the direction of travel; and outputting an indication of the parking space if a confidence value assigned to the section of the street with respect to the same direction of travel exceeds a predetermined threshold value.

If right-hand traffic prevails, the left side of the street is usually the remote side, and if left-hand traffic prevails, the right side of the street is usually the remote side. In particular, the method can refer to the method described above, in which the confidence value, which is used in the second method, is generated with the aid of the first method. The second method can be used to subject left-side measurements to a plausibility check on board the second motor vehicle, so that left-side measurements can be better allowed in certain streets, and better suppressed in other streets.

A computer-program product includes program-code means for carrying out one of the methods described above when the computer-program product runs on a processing device or is stored on a computer-readable data carrier. The methods can also be carried out in part by different processing devices or stored on spatially separate data carriers.

An apparatus for determining a confidence value includes a receiving device for receiving information from first motor vehicles that are driving along a section of a street in the same direction of travel. Provided on board the first motor vehicles are a laterally directed first sensor for scanning a right side of the street and a laterally directed second sensor for scanning a left side of the street, a processing device for determining a first parking space on the right side of the street based on data from the first sensor and a second parking space on the left side of the street based on data from the second sensor, as well as a wireless transmitting device for transmitting information with regard to the determined parking spaces. The apparatus also includes a processing device adapted to ascertain a first accumulation with which first parking spaces were determined on the right side of the street, and a second accumulation with which second parking spaces were determined on the left side of the street; and adapted to ascertain a confidence value based on the first and the second accumulation. Moreover, a wireless transmitting device is provided for making available the confidence value assigned to the section and to the direction of travel.

In particular, the apparatus can be implemented as a central device or server and wirelessly receive information from the first motor vehicles described above, process the information and make a result of the processing available to the second motor vehicle described above. In general, the second motor vehicle can be one of the first motor vehicles. In this sense, a first vehicle can coincide with the second motor vehicle.

An apparatus for determining a parking space in the area of a second motor vehicle driving along a section of a street in a direction of travel includes a laterally directed sensor for scanning a usually remote side of the street; a determination device for determining a confidence value with respect to the section and the direction of travel; and a processing device adapted to determine a parking space based on the scanning and to output an indication of the parking space if the confidence value exceeds a predetermined threshold value. The apparatus is able to allow the second motor vehicle to evaluate a scanning of the left side of the street based on the previously determined confidence value. Unimportant or noisy measurements can thereby be better suppressed. A quantity of falsely output parking spaces determined on the left side is able to be reduced.

The present invention is described in greater detail below with reference to the accompanying drawings.

DETAILED DESCRIPTION

Figure 1:
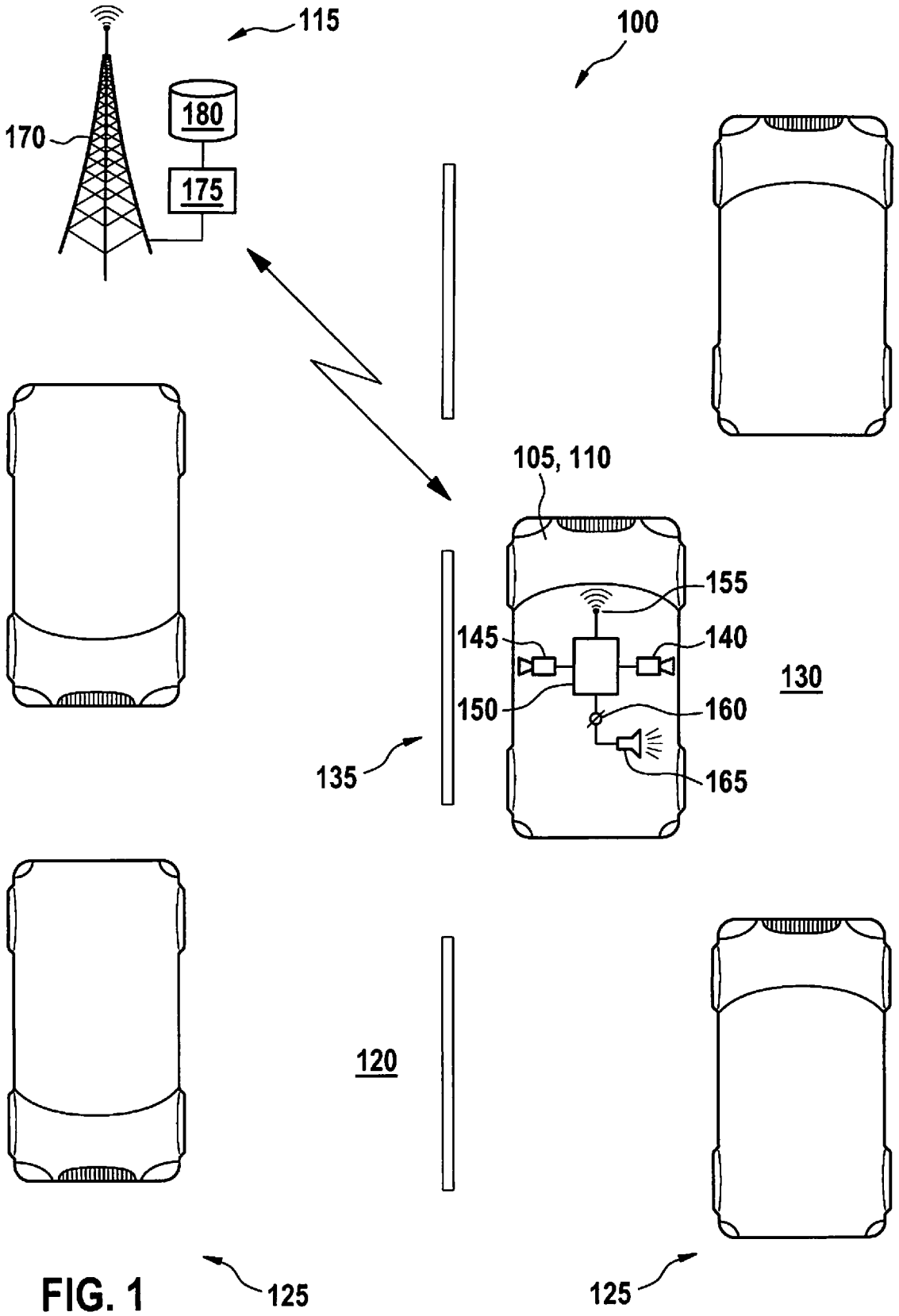
FIG. 1 shows a system with a first motor vehicle, a second motor vehicle, and a central device, according to an example embodiment of the present invention.

FIG. 1 shows a system 100 having a first motor vehicle 105, a second motor vehicle 110, and a central device 115, which can also be referred to as server. Motor vehicles 105, 110 are on a street 120 having a left and a right side 125. Motor vehicles 105, 110 are driving along street 120 in the same direction of travel, and in each case are scanning their surroundings to the side in order to determine parking spaces 130 which are suitable for parking a motor vehicle 105, 110. As shown more clearly below, a multitude of first vehicles 105 is used to determine a confidence value, specific to the direction of travel and a section 135 of street 120, from the scannings by first motor vehicles 105. The confidence value is usually determined, stored, or made available by central device 115. Scannings by second motor vehicle 110 in the same direction of travel in the same section 135 can then be better processed based on the confidence value.

First motor vehicle 105 includes a first sensor 140 directed laterally to the right, a second sensor 145 directed laterally to the left, a processing device 150, and a wireless interface 155. For example, sensors 140, 145 can include ultrasonic-, radar-, or LIDAR sensors. They are furnished to scan respective right or left side 125 of the street, in order to sense a parking space 130. Parking space 130 can be determined using processing device 150 based on measuring signals. Wireless interface 155 is furnished to exchange information with central device 115. In this context, any radio technology can be used, for instance, mobile radio communication or WLAN.

Second motor vehicle 110 includes the same elements, it also being possible to dispense with first sensor 140. However, if the intention is for second motor vehicle 110 to be able to function as first motor vehicle 105 as well, then first sensor 140 is provided. Second motor vehicle 110 also includes an interface 160 for the output of a signal. An output device 165, which in particular is directed to a driver of second motor vehicle 110 and can be implemented visually, acoustically, or haptically, is connected preferably to interface 160. However, interface 160 can also lead to a further control unit on board second motor vehicle 110.

Central device 115 preferably includes a wireless interface 170 for communicating with wireless interface 155 of first motor vehicle 105 or of second motor vehicle 110, a processing device 175, and preferably a memory device 180. Central device 115 is equipped to receive information with regard to parking spaces 130 from a plurality of first motor vehicles 105, and based on that, to determine a confidence value which is specific to a section 135 of street 120 and the direction of travel of first motor vehicle 105. A multitude of confidence values can be stored in memory 180, in order to characterize adjacent sections 135 of street 120, an entire street 120, or a street network. In addition, central device 115 is equipped to receive a request from a second motor vehicle 110, the request including a section 135 of street 120 and a direction of travel. In response to the request, central device 115 is able to deliver a matching confidence value back to second motor vehicle 110 with the aid of wireless interfaces 170 and 155.

Figure 2:
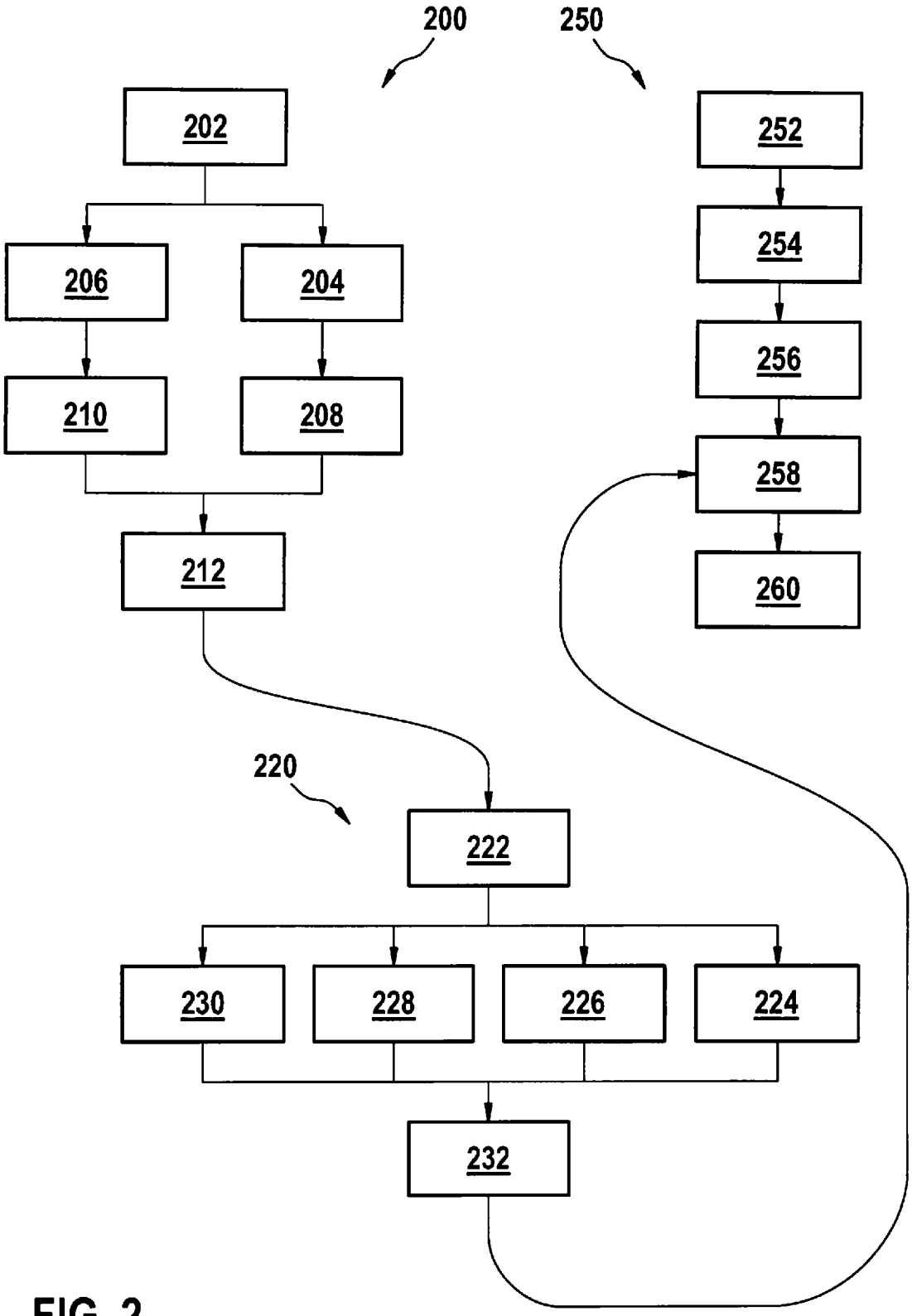
FIG. 2 is a flowchart of methods in the system from FIG. 1, according to an example embodiment of the present invention.

FIG. 2 illustrates a first method 200, a second method 220, and a third method 250, which can be interlinked in order to improve the scanning, processing, and utilization of parking-space information. Preferably, first method 200 is carried out in first motor vehicle 105, second method 220 in central entity 115, and third method 250 in second motor vehicle 110.

In first method 200, in a first step 202, first motor vehicle 105 is traveling along section 135 of street 120 in a predetermined direction of travel. In a step 204, right side 125 of street 120 is scanned by first sensor 140, and in a step 206, left side 125 of street 120 is scanned by second sensor 145. Based on the scannings, in steps 208 and 210, parking spaces 130 are determined on the respective right and left sides of first motor vehicle 105. In a step 212, information about determined parking spaces 130 is transmitted with the aid of wireless interface 155 to central device 115.

In second method 220, in a step 222, information is received from first motor vehicle 105 with the aid of wireless interface 170. Based on the received information, in particular, a frequency of parking spaces 130 determined on the right side can be ascertained in a step 224, a measurement noise of the determinations can be ascertained in a step 226, a quantity of scannings by first motor vehicles 105 can be ascertained in a step 228, and frequencies of parking spaces 130 determined on the left side can be ascertained in a step 230. Based on several or more of these results and items of information, in a step 232, a confidence is determined which expresses the probability with which a parking space 130 determined on left side 125 of street 120 actually also corresponds to an available parking space 130, and is not just the result of a measuring error.

In third method 250, in a step 252, section 135 of street 120 is traveled by second motor vehicle 110. In a step 254, second sensor 145 scans on the left side. Based on the scanning, in a step 256, a parking space 130 is determined on left side 125 of street 120. In a step 258, a confidence or a confidence value is acquired which is specific to the direction of travel of second motor vehicle 110 and section 135 of street 120 on which initially supposed parking space 130 is located. To that end, with the aid of wireless interface 155, second motor vehicle 110 can transmit a corresponding request to central entity 115 and receive a pertinent response. Naturally, confidence values with respect to sections 135 of street 120 can also be requested in anticipation from central entity 115 by second motor vehicle 110, so that the confidence values are available if second motor vehicle 110 detects a parking space 130 on the left side. In a step 260, an indication of parking space 130 is output if the confidence in connection with section 135 indicates that the measurement can be trusted. To that end, in particular, it can be checked whether the confidence exceeds a predetermined threshold value.

Figure 3:
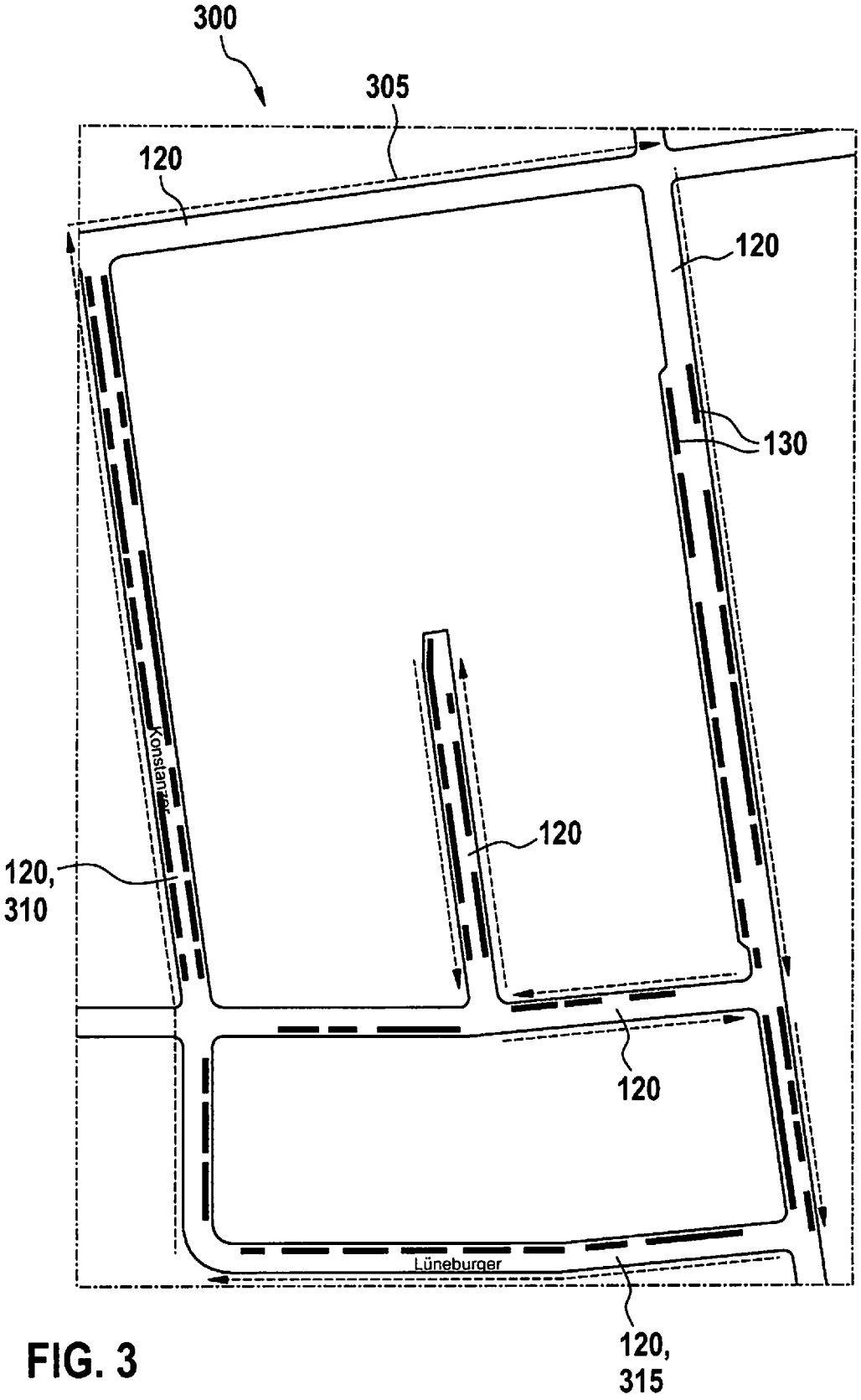
FIG. 3 illustrates an implementation on example streets according to an example embodiment of the present invention.

FIG. 3 shows an exemplary street network 300 to illustrate the technique presented. Streets 120 of street network 300 are driven along by first and second motor vehicles 105, 110 in a predetermined direction of travel 305. Purely by way of example, directions of travel 305 join together here to form an endless loop. Parking spaces 130 on the right and left side of streets 120 are entered symbolically as bars. In the following, two streets 120 are looked at more closely, of which a first street 310 runs vertically in the left section of the figure, and a second street 315 runs horizontally in the lower section.

Figure 4A:
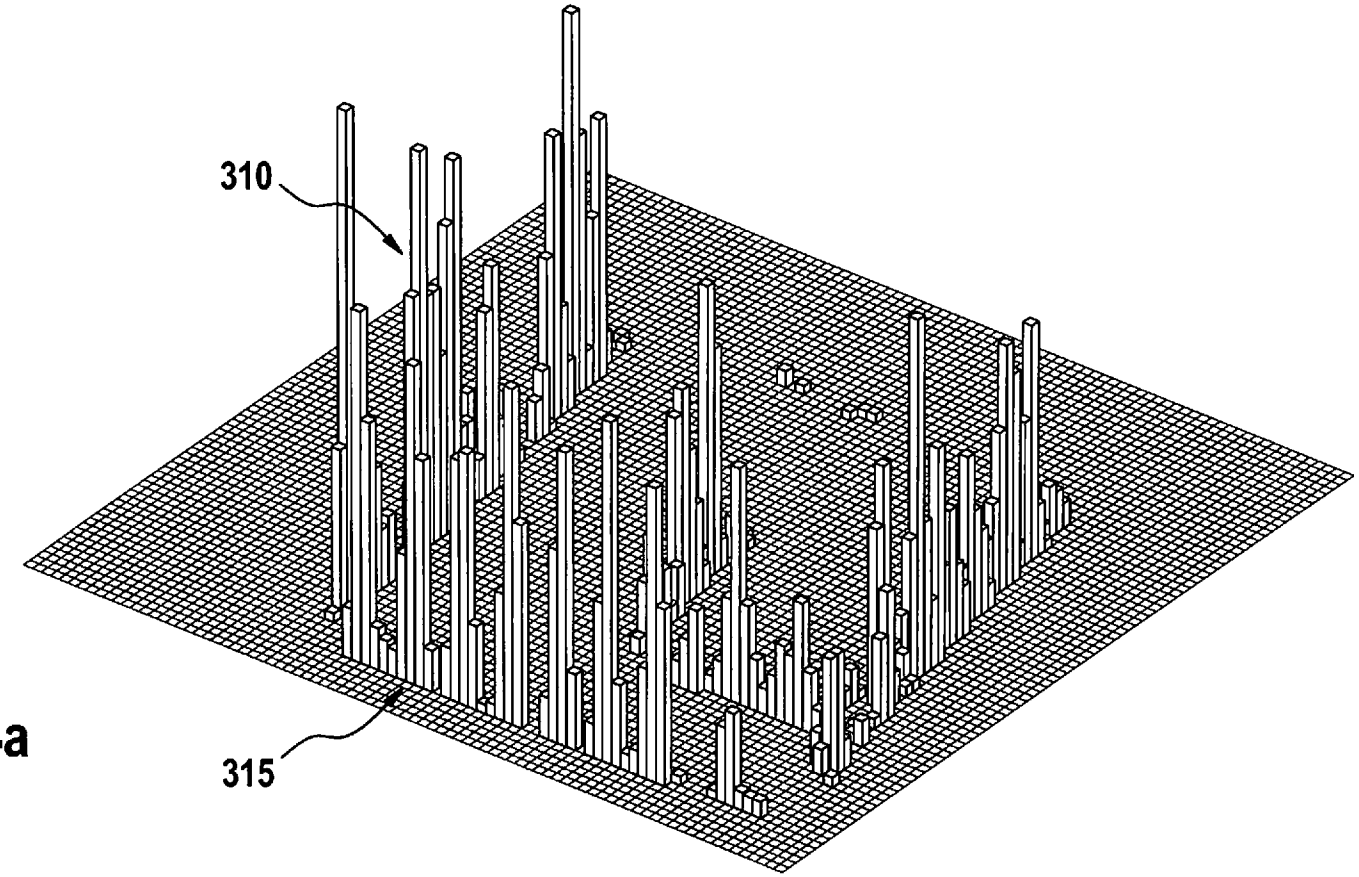
FIGS. 4*a* and 4*b* show accumulations of parking spaces determined on the streets of FIG. 3, according to an example embodiment of the present invention.
Figure 4B:
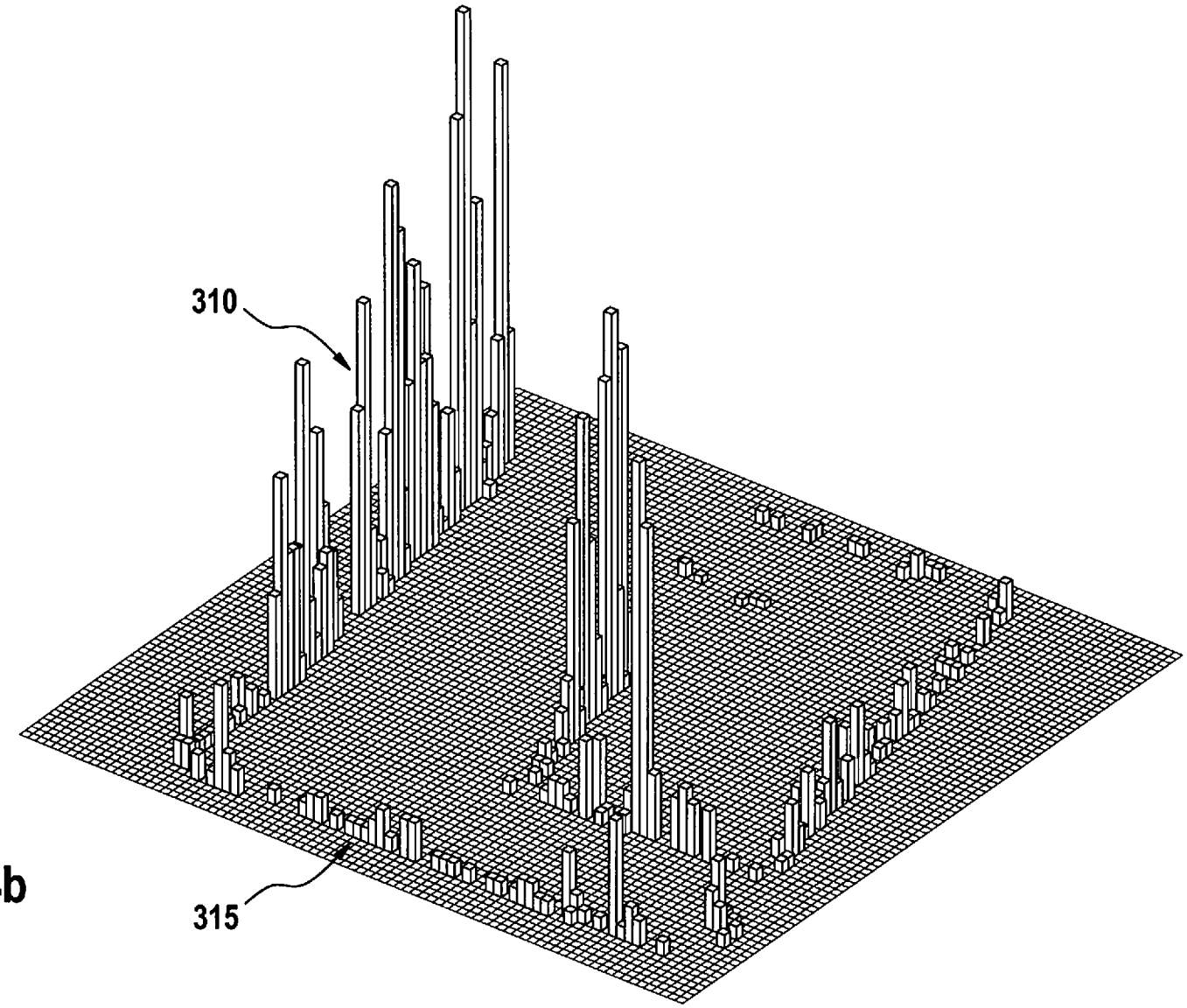

FIGS. 4*a* and 4*b* show abstract representations of frequencies of detected parking spaces 130 after a multitude of first motor vehicles 105 has traveled through. FIG. 4*a* shows frequencies of parking spaces 130 determined on the right side and FIG. 4*b* shows frequencies of parking spaces 130 determined on the left side. Each scanning or parking space 130 relates to a section 135 of a street 120 and measurements with the aid of a multitude of first motor vehicles 105. Routings of streets 120 are entered in the horizontal direction according to the representation of FIG. 3, and the frequencies are entered in the vertical direction.

It can be seen that in first street 310, the accumulations on the left side and the right side resemble each other, while such a correlation does not hold true in the case of second street 315. A confidence value in sections 135 of first street 310 is therefore high, while low confidence values apply along second street 315. A second motor vehicle 110 is able to accept a measurement on the left side indicating a parking space 130 in first street 310 because of the high confidence value applicable there. On the other hand, the same measuring result in second street 315 can be discarded because of the low confidence value applicable there.

What is claimed is:

1. A method comprising:

obtaining from a plurality of motor vehicles traveling along a section of a street in a same direction of travel:

an indication of right parking spaces on a right side of the section of the street determined by the plurality of motor vehicles by scanning the right side of the street using respective first sensors that are directed laterally to respective right sides of the respective motor vehicles; and an indication of left parking spaces on a left side of the section of the street determined by the plurality of motor vehicles by scanning the left side of the street using respective second sensors that are directed laterally to respective left sides of the respective motor vehicles;

ascertaining a confidence value based on a combination of the indicated right parking spaces and a combination of the indicated left parking spaces; and assigning the confidence value to the section and the direction of travel, wherein a greater a correlation between a frequency of the indicated left parking spaces and a frequency of the indicated right parking spaces, a higher the confidence value.

2. The method of claim 1, wherein the ascertaining of the confidence value includes determining a degree of correspondence between the combination of the indicated right parking spaces and the combination of the indicated left parking spaces, and wherein the greater the degree of correspondence the greater the confidence value is raised based on the degree of correspondence.

3. The method of claim 1, wherein the more the combination of the indicated left parking spaces is made up of measurement noise, the lower the confidence value.

4. The method of claim 3, wherein the measurement noise of the combination of the indicated left parking spaces is determined as uniformly distributed along the street.

5. The method of claim 3, wherein the greater the number of scannings that are performed by first motor vehicles, the less the measurement noise.

6. An apparatus comprising:

a wireless communication interface; and a processor;

wherein the processor is configured to:

obtain, via the wireless communication interface and from a plurality of motor vehicles traveling along a section of a street in a same direction of travel:

an indication of right parking spaces on a right side of the section of the street determined by the plurality of motor vehicles by scanning the right side of the street using respective first sensors that are directed laterally to respective right sides of the respective motor vehicles; and an indication of left parking spaces on a left side of the section of the street determined by the plurality of motor vehicles by scanning the left side of the street using respective second sensors that are directed laterally to respective left sides of the respective motor vehicles;

ascertain a confidence value based on a combination of the indicated right parking spaces and a combination of the indicated left parking spaces;

assign the confidence value to the section and the direction of travel, wherein a greater a correlation between a frequency of the indicated left parking spaces and a frequency of the indicated right parking spaces, a higher the confidence value; and transmit the confidence value to one or more of the motor vehicles via the wireless communication interface.

7. A non-transitory computer-readable medium on which are stored instructions that are executable by a processor and that, when executed by the processor, causes the processor to perform a method, the method comprising:

obtaining from a plurality of motor vehicles traveling along a section of a street in a same direction of travel:

an indication of right parking spaces on a right side of the section of the street determined by the plurality of motor vehicles by scanning the right side of the street using respective first sensors that are directed laterally to respective right sides of the respective motor vehicles; and an indication of left parking spaces on a left side of the section of the street determined by the plurality of motor vehicles by scanning the left side of the street using respective second sensors that are directed laterally to respective left sides of the respective motor vehicles;

ascertaining a confidence value based on a combination of the indicated right parking spaces and a combination of the indicated left parking spaces; and assigning the confidence value to the section and the direction of travel, wherein a greater a correlation between a frequency of the indicated left parking spaces and a frequency of the indicated right parking spaces, a higher the confidence value.

* * * * *